US006187139B1

(12) United States Patent
Edwards et al.

(10) Patent No.: US 6,187,139 B1
(45) Date of Patent: Feb. 13, 2001

(54) WET CREPING PROCESS

(75) Inventors: Steven L. Edwards, Fremont; Robert J. Marinack, Oshkosh, both of WI (US)

(73) Assignee: Fort James Corporation, Deerfield, IL (US)

( * ) Notice: Under 35 U.S.C. 154(b), the term of this patent shall be extended for 0 days.

(21) Appl. No.: 09/354,921

(22) Filed: Jul. 13, 1999

(51) Int. Cl.[7] ..... B31F 1/12

(52) U.S. Cl. ..... 162/111; 162/112; 162/113; 162/206; 264/283

(58) Field of Search ..... 162/111–113, 116, 162/121, 202, 204, 206–207, 109, 117, 359, 361; 264/282–284; 156/183

(56) References Cited

U.S. PATENT DOCUMENTS

| | | |
|---|---|---|
| Re. 28,459 | 7/1975 | Cole et al. . |
| 2,995,459 | 8/1961 | Klenk et al. . |
| 4,448,638 | 5/1984 | Klowak . |
| 4,482,429 | 11/1984 | Klowak . |
| 4,992,140 | 2/1991 | Anderson et al. . |
| 5,336,373 | 8/1994 | Scattolino et al. . |
| 5,494,554 | 2/1996 | Edwards et al. . |
| 5,505,818 | 4/1996 | Hermans et al. . |
| 5,730,839 | 3/1998 | Wendt et al. . |
| 5,851,353 | 12/1998 | Fiscus et al. . |

OTHER PUBLICATIONS

Oliver, John F, *Dry–Creping of Tissue Paper—a Review of Basic Factors*; Presented at the 63rd Annual Chemical Institute of Canada Conference, Jun. 11, 1980, Ottawa, Ont. Canada, accepted May 1980 pp. 215–219.

*Primary Examiner*—Stanley S. Silverman
*Assistant Examiner*—Jose A. Fortuna
(74) *Attorney, Agent, or Firm*—Finnegan, Henderson, Farabow, Garrett & Dunner, LLP

(57) ABSTRACT

The present invention is a method for making a high quality paper product at improved process efficiency through the use of high steam levels in the Yankee dryer. The product according to the present invention is creped from the Yankee dryer while it is still wet and is then drying is completed using conventional methods. Products made according to the present invention exhibit improved absorbency, softness and bulk.

20 Claims, 10 Drawing Sheets

WET CREPING PROCESS

FIELD OF THE INVENTION

The present invention relates to a method of producing a paper product having improved bulk, absorbency and softness. The present invention further relates to a method for producing a paper web by controlling the moisture profile within the paper web to cause delamination of the web during creping. More particularly, the present invention relates to a method of wet creping a paper web having a moisture profile that causes delamination of the web during creping. Still more particularly, the present invention relates to a method for wet creping a paper web where the temperature of the Yankee dryer and the Yankee hood are controlled to provide a dryer Yankee side surface and a wetter air side surface of the paper web.

BACKGROUND

Through air drying (TAD) has changed the industry's ability to produce soft, bulky, premium quality paper products, particularly in the area of single-ply products. TAD has become the preferred choice for newly purchased paper machines because it can provide improved product attributes and therefore, economic advantages to manufacturers when compared with the products produced by conventional wet pressing (CWP). The advent of TAD has made it possible to produce paper products with good initial softness, bulk and absorbency.

In the older conventional wet pressing method, premium quality paper product, tissues and towels, are normally made by forming a nascent web in a forming structure, transferring the web to a dewatering felt where it is pressed to remove moisture and adhering the web to a Yankee dryer. When the web is dried to a solids content greater than 90%, the web is creped from the Yankee dryer and reeled. This process is referred to as a dry creping process because it occurs after the paper web has been sufficiently dried on the Yankee dryer. Dry creping is discussed in John F. Oliver, Drycreping of tissue paper—a review of basic factors, Yankee Dryer and Drying, A TAPPI PRESS Anthology, pages 215–219, which is herein incorporated by reference.

An alternative to dry creping has been a process called wet creping. In a standard wet creping process, the web is formed in the forming structure and transferred to a press felt where it is pressed to mechanically remove water, just as in the dry creping process. In the wet creping process however, the web is adhered to the Yankee dryer, but creped before the web is considered dry, e.g., at a solids content of less than 90%, generally between 40 to 75%. While wet creped webs exhibit higher levels of absorbency than conventional dry creped webs, they also tend to be stiffer and less soft. Wet creped webs while improving on the absorbency of dry creped webs still do not reach the levels of absorbency achieved by the unpressed TAD webs.

Conventional wet pressing, however, has certain advantages over TAD including 1) lower energy costs associated with the mechanical removal of water rather than drying by the passage of hot air; and 2) increased production speeds. Stated differently, energy consumption is lower and the production speeds can be considerably higher than those used in TAD. Thus, there is a need for processes which can attain the attributes of a TAD web without the concomitant expense associated with an unpressed TAD web.

Many have attempted to improve upon the wet crepe process to achieve the benefits of higher absorbency without the added cost of TAD. We have surprisingly found that the wet crepe process according to the present invention produces improved product attributes in webs that are subsequently dried by any art recognized method, including TAD.

One prior proposed method includes the addition of a molded or sculpted pattern to the wet paper web. U.S. Pat. No. 5,851,353 discloses a drying fabric that is capable of imprinting the web during the drying process. Both U.S. Pat. Nos. 5,505,818 and Re. 28,459 disclose wet creping processes followed by application of the wet web to a TAD impression fabric where the web is dried to completion.

While these final drying techniques can improve desired web properties through wet molding, they can be significantly limited by issues surrounding production speed. Wet crepe webs typically suffer from handling problems, and as disclosed in the '353 patent, a significant portion of the final drying must be done while the web is sandwiched between two fabrics. This causes the drying rate to be reduced to very low levels with water removal rates on the order of 1–3 lbs/hour/ft$^2$. Conventional rates for can drying are on the order of 10 lbs/hour/ft$^2$ and conventional TAD removes 10–25 lbs of water/hour/ft$^2$. Both the '818 patent and the '459 reissue also show very low drying rates. These rates are based upon the difficulty in economically pulling a sufficient volume of heated air through the web.

Others have attempted to offset the disadvantages of wet pressing through improved dry creping processes. U.S. Pat. Nos. 4,448,638 and 4,482,429 teach that superior web properties can be attained by making the adhesion of the web to the dryer greater than its internal cohesion. This was achieved through the use of debonders applied to the web in the wet end of the papermaking process. This technique proves unworkable, however, for the production of towels where strength and absorbency are key attributes since the addition of debonder negatively impacts both.

U.S. Pat. No. 4,992,140 discloses a similar reduction in web bond strength independent of the Yankee adhesion. As disclosed in the '140 patent, an amount of water is applied to the outside of the web just prior to creping thereby increasing the average web consistency from 2 to 10% with a concomitant increase in absorbency on the order of 10–25%. These benefits were, however only seen in higher basis weight webs and at higher evaporative loads in the final drying section, thereby making them less economically preferred.

U.S. Pat. No. 2,995,180 discloses a creping blade having alternating bands that contact the Yankee dryer resulting in a web that was smooth on one side and pearlized on the other. The disclosed pearls, like ridges, opened the web in those areas thereby increasing the caliper of the web. This technology suffers from the disadvantage that it may only be applied to very strong webs since only half the web is creped from the Yankee dryer, while the other half of the web is pulled from the Yankee dryer.

U.S. Pat. Nos. 5,494,554 and 5,730,839 disclose that when adhesion to the Yankee surface is increased during dry creping and the correct blade angle is used, high levels of web breakup can be expected. Each of these processes are however, concerned with a dry creping process, where the web solids content is greater than 95% and the web temperature is on the order of 235° F. Wet creping, by contrast, is carried out a web solids content, typically of, 40 to 75%. U.S. Pat. No. 5,377,428 discloses that in the solids content range where wet creping usually takes place, the web temperature is expected to be about 180° F. to about 200° F.

U.S. Pat. No. 5,336,373 discloses that during the drying process the water that remains in the web migrates to the parts of the web that are in contact with the heated surface. The '373 patent established this through the use of dyes that did not adhere to the fibers during the drying process. With the water migration toward the heated surface, during wet creping, one would expect that the highest water content would be in the Yankee side of the web. Both this high moisture content and the low temperatures would tend to reduce the strength of the adhesive bond between the web and the Yankee dryer, thus, resulting in a reduced creping effect.

U.S. Pat. No. 5,556,511 discloses a non-creped product that is produced on a heated press. The '511 patent teaches that a general explosion of the sheet may be accomplished by the steam within the sheet. This explosion of the sheet is a disruption of the fibers, but is not a clear delamination plane within the sheet that effectively results in plies within the web. Exploded sheets such as those disclosed in the '511 patent suffer large tensile losses, while in a delaminated sheet tensile losses are significantly reduced.

The current trend is away from conventional wet pressing in favor of TAD production since TAD offers the advantages higher caliper, molded or shaped webs and improved absorbency and softness. The present invention utilizes the advantageous cost of conventional wet pressing, but achieves product attributes of bulk, absorbency and softness that are much closer to TAD than anything previously known.

The present invention overcomes the disadvantages associated with prior art wet creping processes and produces a web that parallels that formed through the more expensive TAD processes. The present invention also surprisingly provides a paper web with superior handling properties during the wet creping process.

Further advantages of the invention will be set forth in part in the description which follows and in part will be apparent from the description. The advantages of the invention may be realized and attained by means of the instrumentalities and combinations particularly pointed out in the appended claims.

SUMMARY OF THE INVENTION

To achieve the foregoing advantages and in accordance with the purpose of the invention, as embodied and broadly described herein, there is disclosed:

A method for causing delamination of the fibers within a fibrous web including forming a nascent web from a fibrous slurry; adhering the web to dryer from which it can be creped; creping the web from the dryer at a solids content below about 90% and when the web has a moisture profile that causes the fibers to shear, thereby resulting in delamination.

There is further disclosed:

A method of forming a paper web including forming a nascent web from a fibrous slurry; adhering the nascent web to a dryer which is at a pressure between about 50 and 150 psi; creping the web from said dryer at a solids content between about 30% and 90%; contacting the web with a second dryer to cause drying of the web to a solids content of greater than 95%.

The accompanying drawings, are included to provide a further understanding of the invention and are incorporated in and constitute a part of the specification. The drawings illustrate embodiments of the invention and, together with the description, serve to explain the principles of the invention.

DETAILED DESCRIPTION

The present invention is directed to a method of making a paper product having improved bulk, absorbency and softness. The paper product according to the present invention can be manufactured on any papermaking machine of conventional forming configuration.

Figure 1:
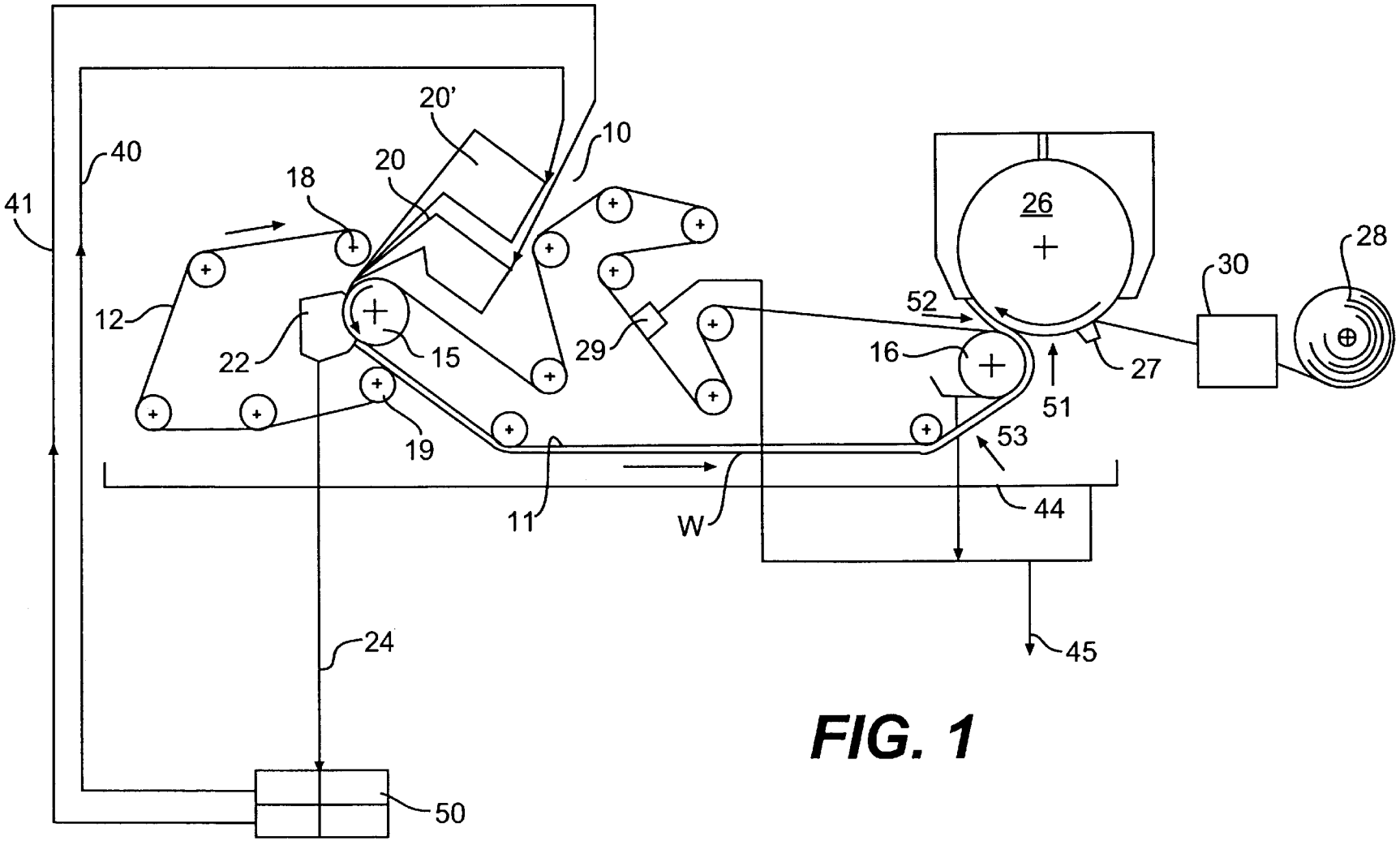
FIG. 1 illustrates one wet crepe apparatus that may be used according to the present invention.

FIG. 1 illustrates one embodiment of the present invention where a machine chest 50, which may be compartmentalized, is used for preparing furnishes that are treated with chemicals having different functionality depending on the character of the various fibers used. This embodiment shows two headboxes thereby making it possible to produce a stratified product. The product according to the present invention can be made with single or multiple headboxes and regardless of the number of headboxes may be stratified or unstratified. The treated furnish is transported through different conduits 40 and 41, where they are delivered to the headbox of a crescent forming machine 10.

FIG. 1 shows a web-forming end or wet end with a liquid permeable foraminous support member 11 which may be of any conventional configuration. Foraminous support member 11 may be constructed of any of several known materials including photopolymer fabric, felt, fabric or a synthetic filament woven mesh base with a very fine synthetic fiber batt attached to the mesh base. The foraminous support member 11 is supported in a conventional manner on rolls, including breast roll 15 and couch or pressing roll, 16.

Forming fabric 12 is supported on rolls 18 and 19 which are positioned relative to the breast roll 15 for pressing the press wire 12 to converge on the foraminous support member 11 at the cylindrical breast roll 15 at an acute angle relative to the foraminous support member 11. The foraminous support member 11 and the wire 12 move in the same direction and at the same speed which is the same direction of rotation of the breast roll 15. The pressing wire 12 and the foraminous support member 11 converge at an upper surface of the forming roll 15 to form a wedge-shaped space or nip into which one or more jets of water or foamed liquid fiber dispersion is pressed between the pressing wire 12 and the foraminous support member 11 to force fluid through the wire 12 into a saveall 22 where it is collected to reuse in the process.

The nascent web W formed in the process is carried by the foraminous support member 11 to the pressing roll 16 where the wet nascent web W is transferred to the drum 26 of a Yankee dryer. Fluid is pressed from the wet web W by pressing roll 16 as the web is transferred to the drum 26 of a dryer where it is partially dried and creped by means of a creping blade 27. The web then transferred to an additional drying section 30 to complete the drying of the web, prior to being collected on a take-up roll 28. The drying section 30 can have any art recognized configuration, including but not limited to, TAD, can dryers, impulse dryers, and the like.

A pit 44 is provided for collecting water squeezed from the furnish by the press roll 16 and a Uhle box 29. The water collected in pit 44 may be collected into a flow line 45 for separate processing to remove surfactant and fibers from the water and to permit recycling of the water back to the papermaking machine 10.

According to the present invention, an absorbent paper web can be made by dispersing fibers into aqueous slurry and depositing the aqueous slurry onto the forming wire of a paper making machine. Any art recognized forming scheme might be used. For example, an extensive but non-exhaustive list includes a crescent former, a C-wrap twin wire former, an S-wrap twin wire former, a suction breast roll former, a fourdrinier former, or any art recognized forming configuration. The particular forming apparatus is not critical to the success of the present invention. The forming fabric can be any art recognized foraminous member including single layer fabrics, double layer fabrics, triple layer fabrics, photopolymer fabrics, and the like. Non-exhaustive background art in the forming fabric area include U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,467; 5,211,815; 5,219,004; 5,245,025; 5,277,761; 5,328,565; and 5,379,808 all of which are incorporated herein by reference in their entirety. The particular forming fabric is not critical to the success of the present invention. One forming fabric found particularly useful with the present invention is Appleton Mills Forming Fabric 2184 made by Appleton Mills Forming Fabric Corporation, Florence, Miss.

Papermaking fibers used to form the absorbent products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention. These fibers include non-woody fibers liberated from sugar cane, bagasse, sabai grass, rice straw, banana leaves, paper mulberry (i.e., bast fiber), abaca leaves, pineapple leaves, esparto grass leaves, and fibers from the genus Hesperaloe in the family Agavaceae. Also recycled fibers which may contain any of the above fiber sources in different percentages, can be used in the present invention. Suitable fibers are disclosed in U.S. Pat. Nos., 5,320,710 and 3,620,911, both of which are incorporated herein by reference.

Papermaking fibers can be liberated from their source material by any one of the number of chemical pulping processes familiar to one experienced in the art including sulfate, sulfite, polysulfide, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if necessary, by a number of familiar bleaching schemes including alkaline peroxide and ozone bleaching.

The suspension of fibers or furnish may contain chemical additives to alter the physical properties of the paper produced. These chemistries are well understood by the skilled artisan and may be used in any known combination.

The pulp can be mixed with strength adjusting agents such as wet strength agents, dry strength agents and debonders/softeners. Suitable wet strength agents will be readily apparent to the skilled artisan. A comprehensive but non-exhaustive list of useful wet strength aids include urea-formaldehyde resins, melamine formaldehyde resins, glyoxylated polyacrylamide resins, polyamide-epichlorhydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the tradename of PAREZ 631 NC by Cytec Industries. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorhydrin resins, an example of which is sold under the tradenames Kymene 557LX and Kymene 557H by Hercules Incorporated of Wilmington, Del. and CASCAMID® from Borden Chemical Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in Wet-Strength Resins and Their Application (L. Chan, Editor, 1994), herein incorporated by reference in its entirety. A reasonably comprehensive list of wet strength resins is described by Westfelt in *Cellulose Chemistry and Technology*, Volume 13, p. 813, 1979, which is incorporated herein by reference.

Suitable dry strength agents will be readily apparent to one skilled in the art. A comprehensive but non-exhaustive list of useful dry strength aids includes starch, guar gum, polyacrylamides, carboxymethyl cellulose and the like. Of particular utility is carboxymethyl cellulose, an example of which is sold under the tradename Hercules CMC by Hercules Incorporated of Wilmington, Del.

Suitable debonders will be readily apparent to the skilled artisan. Debonders or softeners may also be incorporated into the pulp or sprayed upon the web after its formation. The present invention may also be used with softener materials within the class of amido amine salts derived from partially acid neutralized amines. Such materials are disclosed in U.S. Pat. No. 4,720,383. Evans, Chemistry and Industry, Jul. 5, 1969, Pp. 893–903; Egan, *J. Am. Oil Chemist's Soc.*, Vol. 55 (1978), Pp.118–121; and Trivedi et al., *J. Am. Oil Chemist's Soc.*, June 1981, Pp. 754–756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these material are quaternary ammonium compounds, the compositions as a whole are pH-sensitive. Therefore, in the practice of the present invention with this class of chemicals, the pH in the headbox should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. These compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

The fibrous web is then preferably deposited on a dewatering felt and water is mechanically removed from the web. Any art recognized fabrics or felts could be used with the present invention. For example, a non-exhaustive list of impression fabrics would include plain weave fabrics described in U.S. Pat. No. 3,301,746; semi-twill fabrics described in U.S. Pat. Nos. 3,974,025 and 3,905,863; bilaterally-staggered-wicker-basket-cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480, 4,637,859, 4,514,345, 4,528,339, 5,364,504, 5,334,289, 5,275,799, and 5,260,171; and fabrics containing diagonal pockets described in U.S. Pat. No. 5,456,293. The aforementioned patents are incorporated herein by reference, in their entirety. Any art-recognized-felt can be used with the present invention. For example, felts can have double-layer base weaves, triple-layer base weaves, or laminated base weaves. Preferred felts according to the present invention are those having the laminated base weave design. A wet-press-felt found particularly useful with the present invention is AMFlex 3 made by Appleton Mills Corporation. Non-exhaustive background art in the press felt area includes U.S. Pat. Nos. 5,657,797; 5,368,696; 4,973,512; 5,023,132; 5,225,269; 5,182,164; 5,372,876; and 5,618,612 all-of-which are incorporated herein by reference in their entirety.

While the product according to the present invention is preferably made by wet pressing, any art recognized means for forming a nascent web that has a solids content of 30 to 90% upon creping from a dryer is fully suitable for use in the present invention. This may include transfer of the nascent web from the forming fabric to an impression fabric prior to application of the nascent web to the dryer from which it will be creped. As stated, the preferred drying method is conventional wet pressing, i.e., on a pressing felt, followed by adherence to a Yankee dryer. This is a preferred mode of operation due to the reduced energy costs associated with wet creping over through-air-drying.

The web is adhered to the Yankee dryer by nip transfer by pressing. The transfer may be accomplished by any art recognized method including, but not limited to, press rolls and belts. The machine configuration used to transfer the web to the Yankee can be any method that allows one to adhere the web to the dryer and create a profile that causes delamination upon creping. While the specification generally makes reference to the dryer from which the web is creped as a Yankee dryer, it should be understood that any dryer from which the web can be creped can be used. One example of an alternative configuration would include the use of an impulse drying wide-shoe press against a heated back roll.

Any suitable art recognized adhesive might be used on the Yankee dryer. Preferred adhesives include polyvinyl alcohol with suitable plasticizers, glyoxylated polyacrylamide with or without polyvinyl alcohol, and polyamide epichlorohydrin resins such as Quacoat A-252 (QA252), Betzcreplus 97 (Betz+97) and Calgon 675 B. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307. Typical release agents can be used in accordance with the present invention.

The adhesive is preferably added in an amount of greater than about 0.1 lbs/ton, more preferably greater than about 0.25 lbs/ton, and most preferably between about 0.5 and about 1.0 lb/ton.

The nascent web adhered to the dryer preferably has a solids content of from about 30 to about 90, more preferably from about 45 to about 75 and still more preferably from about 55 to about 65.

The temperature of the dryer from which the web is to be creped can be controlled to provide a moisture profile within the web that causes delamination of the web during creping.

In a preferred embodiment, the Yankee dryer temperature and the Yankee hood temperature are controlled to provide a moisture profile in the web which causes delamination of the fibers during creping. In one preferred embodiment, this delamination is achieved through the use of increased heat to the Yankee dryer and decreased heat to the Yankee hood. Conventionally, more heat is applied from the Yankee hood than from the Yankee dryer. Conventional operation causes drying of the web on both sides, resulting in acceptable dry creping. When the heat to the Yankee is increased and the heat from the hood is decreased, the primary heat source contacting the web is the Yankee dryer. This causes the Yankee side of the web to be at a higher temperature than the air side of the web. This also causes the Yankee side of the web to be dryer than the air side of the web. It is through the control of this moisture profile that delamination of the web occurs.

The Yankee dryer is preferably at a pressure of from about 50 to about 150 psi steam pressure, more preferably at pressure of from about 90 to about 150, and still more preferably at a pressure of from about 110 to about 150 psi. During wet creping the Yankee dryer side of the sheet immediately after creping is preferably at a temperature of from about 180 to about 230° F., more preferably at a temperature from about 195 to about 225° F. and most preferably at a temperature of from about 195 to about 225° F. and still more preferably at a temperature of from about 205 to about 220° F. (As measure by IR using a emissivity setting of about 0.85 to 0.9).

The side of the sheet away from the Yankee dryer, when measured under similar circumstance, exhibits a temperature of about 210° F. or less, more preferably about 200° F. or less, still more preferably less than about 190° F. Delamination is best affected when the temperature sidedness of the sheet measured just after creping is at least about 5° F., more preferably at least about 10° F., still more preferably at least about 20° F. In the case of the wide shoe press/impulse drying. This differential is best controlled by maintaining an outside side sheet temperature (while on the roll but before creping) of about 220 degrees of less, more preferably about 210 degrees or less, still more preferably about 190 degrees or less. In maintaining the temperatures in this manner one can be assured that there is a moisture differential sufficient in the sheet to produce the delamination effect. This is believed to be based upon the roll side of the sheet being dry just prior to creping. The dryness of a single side can be determined by the temperature exhibited by the side of the web in contact with the Yankee dryer. Because of the very high heat possible using an impulse dryer, the extent to which the web needs to be wrapped around the heated roll can be minimized to better control this temperature differential. In order to use an impulse dryer in the process according to the present invention, it is preferably that the shoe be designed to create sufficient adhesion between the web and the dryer to result in delamination upon creping.

Delamination is generally indicated by internal planarization of the fibers. Delamination can be determined using a freeze test. The freeze test is according to TAPPI UM-576 Method entitled, Beloit Sheet Splitter.

The variables that affect delamination include Yankee hood temperature, Yankee dryer temperature, creping adhesive composition, blade angle, moisture content of the web at the time of creping, chemistries used, stratification, fiber composition, basis weight, rate of heat transfer and time of drying.

Not wishing to be bound by theory, it is believed that the Yankee side of the web is sufficiently dry so as to act in the same manner as a completely dry web would during the creping operation. Since the other side of the web is significantly wetter, as the web is creped, a shear plane exists within the web resulting in delamination of the wetter part of the web from the dryer part of the web.

Creping is generally effected by scraping the web that has been fixed to a Yankee drier with an adhesive/release agent from the Yankee by means of a creping blade. Any currently art recognized, or after developed creping blade may be used in the process according to the present invention. The creping blade, in one preferred embodiment may be the patented Taurus blade, an undulatory creping blade, disclosed in U.S. Pat. No. 5,690,788, which is incorporated herein by reference in its entirety. This Taurus blade presents differentiated creping and rake angles to the sheet and having a multiplicity of spaced serrulated creping sections of either uniform depths or non-uniform arrays of depths. The depths of the undulations are above about 0.008 inches.

Creping, by breaking a significant number of inter-fiber bonds, adds to and increases the perceived softness of resulting tissue or towel product.

The creping angle is preferably between about 60 and about 95 degrees, more preferably between about 65 and about 90 degrees, and most preferably between about 70 and about 85 degrees. Decreasing the blade bevel from about 15 degrees ( creping angle 72 degrees) shows an increase in the breakup and delamination of the web which is reflected as an increase in void volume and clearer separation of the two delaminated layers. Unless handled correctly, the 0 degree blade caused actual disruptions of the top side layer of the sheet. Care must be taken to adjust the sheet take away angle from the creping pocket to insure that the line of the sheet draw be at or above the line of the creping blade surface. In this manner the sheet can be pulled out of the creping pocket before the nearly (or completely) delaminated sheets are damaged to the extent that they cannot be used for tissue or towel products.

Not wishing to be bound by theory, the process according to the present invention is believed to act in most respects exactly as the dry creping process acts. Thus, it is believed that the process according to the present invention may only be modified to improve runnability in a manner consistent with standard dry crepe protocols.

These dry crepe protocols include but are not limited to: creping angles, adhesive add-on rates, release add-on rates, sheet temperature (of the Yankee dryer side), blade changes, sheet threading, and crepe ratio (speed of the sheet take-away relative to the creping cylinder). In short, the creping process is believed to behave quite similar to a dry crepe process and operators can use their existing understanding of these creping variables to adjust and control this process. The additional information the operator needs to know and control the temperature differentials across the sheet at the creping blade. These temperatures are indicative of the moisture differential across the sheet and therefore the propensity of the sheet to delaminate at creping. In could be particularly desirable to be able to change the creping pocket angle on the fly so as to have a direct means of controlling the downstream permeability of the sheet. In this manner, the subsequent drying of the sheet could be optimized for maximum production rates. For example, reduced air permeability will reduce TAD drying rates significantly. The operator could then close the creping pocket (reduce the creping angle) to regain this lost permeability. In this manner he would be able to maintain both productivity and sheet quality throughout the life of the creping blade. Or he could make grade changes without the need to break the sheet down at this critical creping step.

Drying of the web after creping is completed using any conventional drying form including, for example, through-air-drying (TAD), can drying or impulse drying. Transfer of the wet web to the after-dryer can be accomplished using any currently art recognized or after developed method for handling a wet web.

Figure 2:
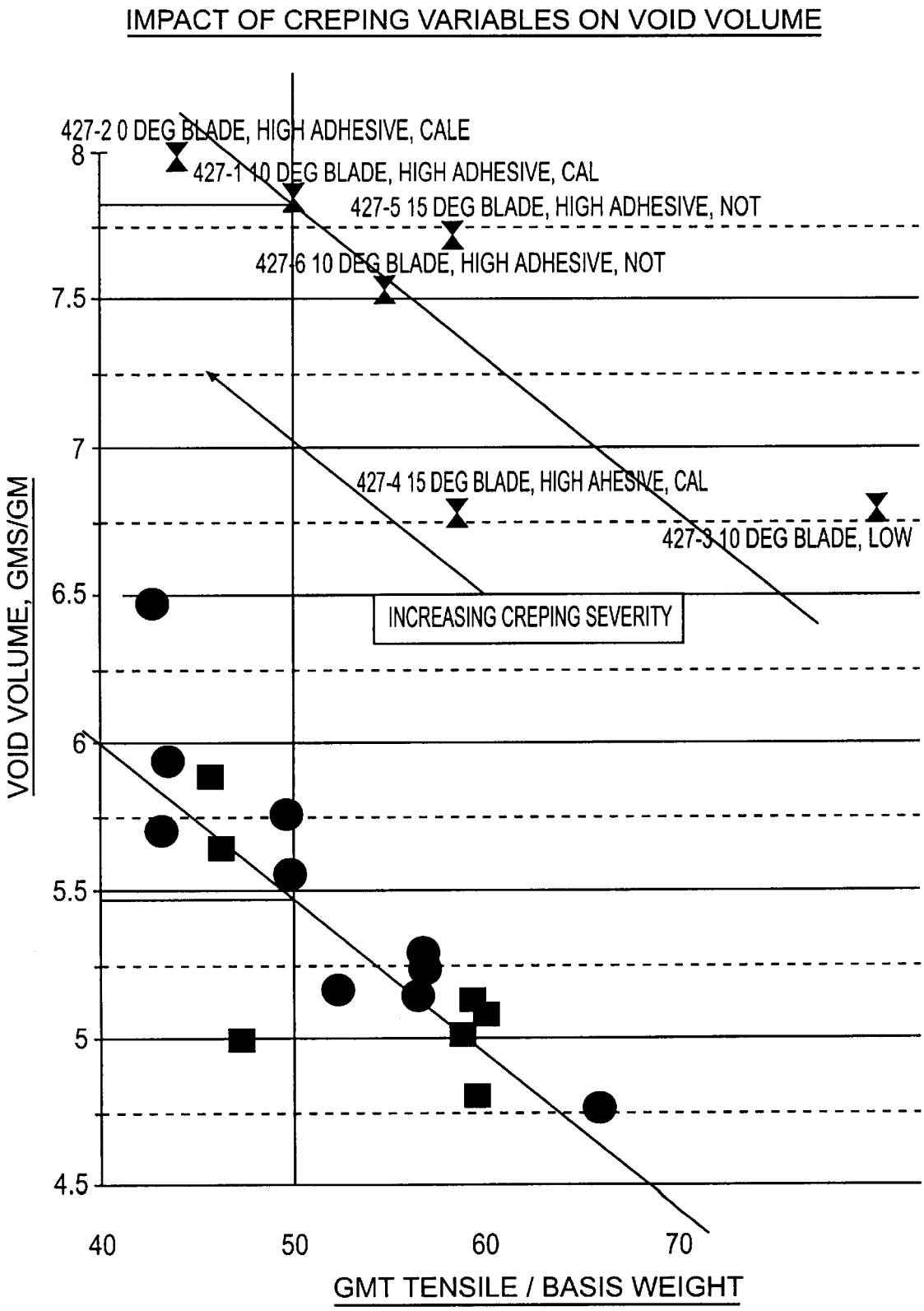
FIG. 2 is a graphical representation of the impact creping variables can have on void volume of the resulting web.
Figure 3:
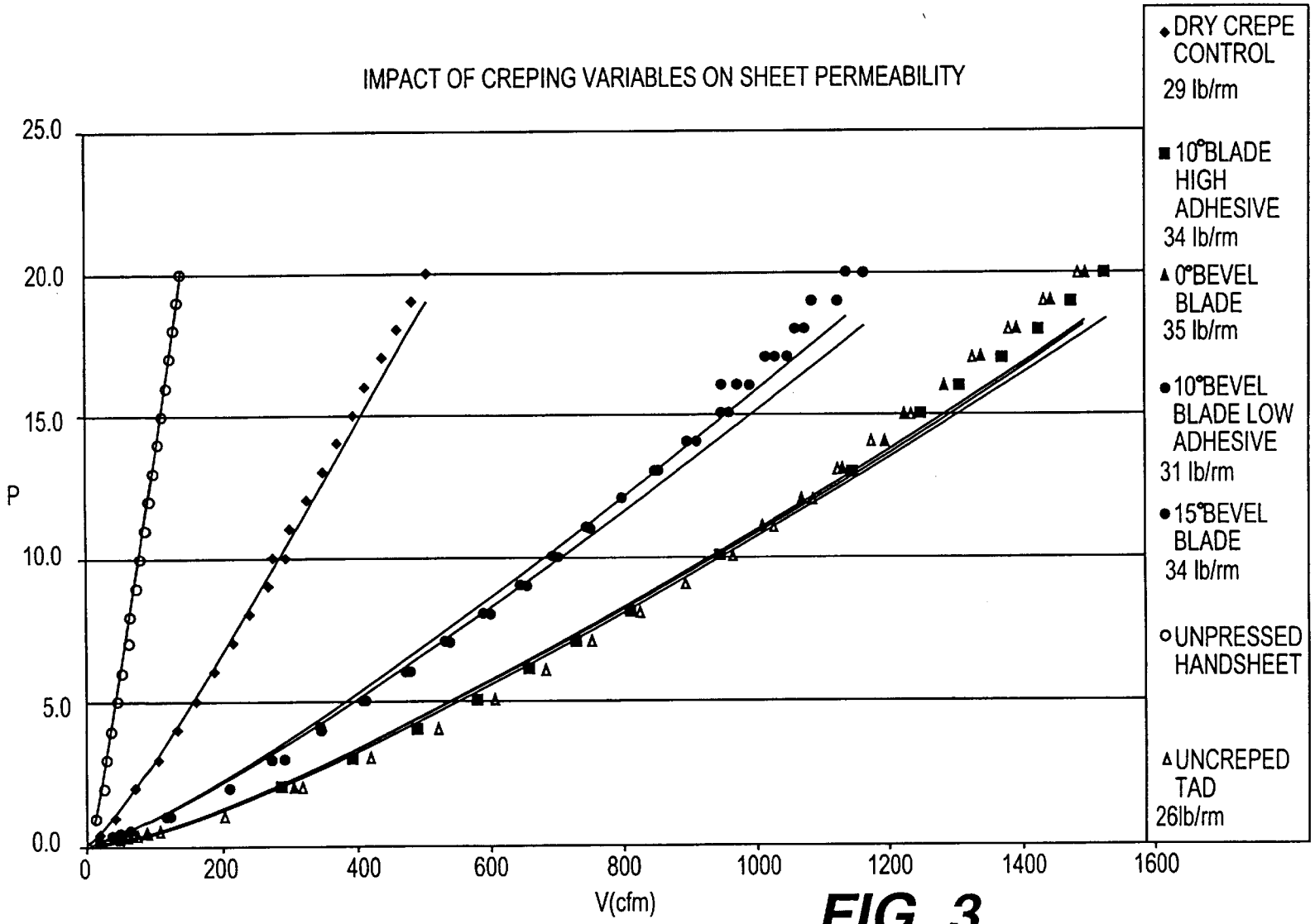
FIG. 3 is a graphical representation of the impact creping variable can have on web permeability of the resulting web.

FIG. 2 shows the response of the internal void volume of the web, as measure by the Porofil void volume test, to creping blade angle, or creping pocket. While in the process according to the present invention, decreases in tensile strengths may be observed, the high void volume of the product according to the present invention allows these decreases to easily be offset by using pattern densification which is well understood from traditional TAD processes. FIG. 3 shows a similar response in the air permeability of the web. As can be seen from FIG. 3, the air permeability of the web according to the present invention is significantly above that which one or ordinary skill would expect for a similar dry creped product, which today is commonly used to predict the through air dryability of the web.

Figure 4:
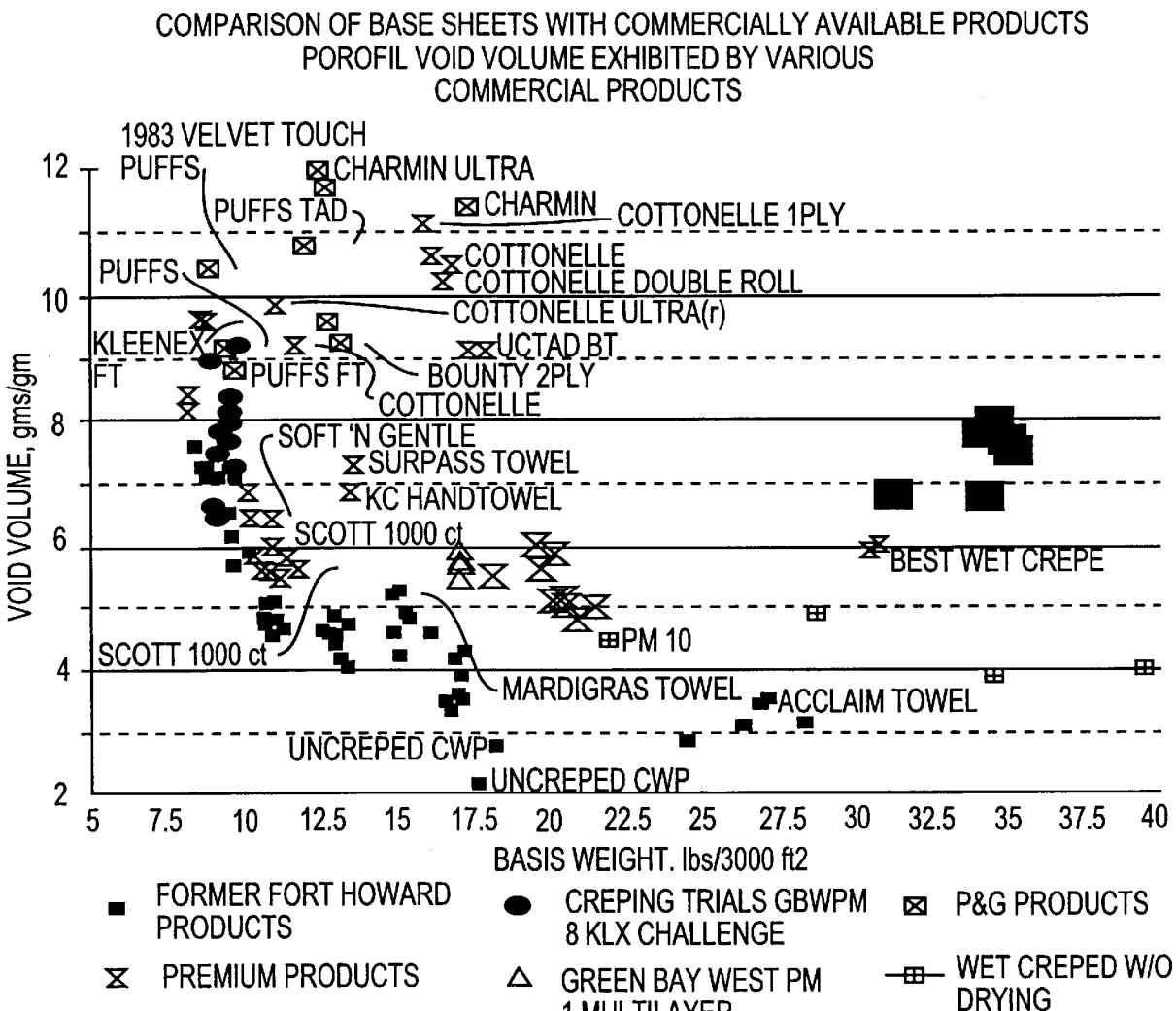
FIG. 4 is a graphical comparison between products according to the present invention and those that a currently available on the market.

FIG. 4 illustrates the relative position of the product according to the present invention and those found in the market place based upon a comparison of basis weight and void volume.

Figure 8:
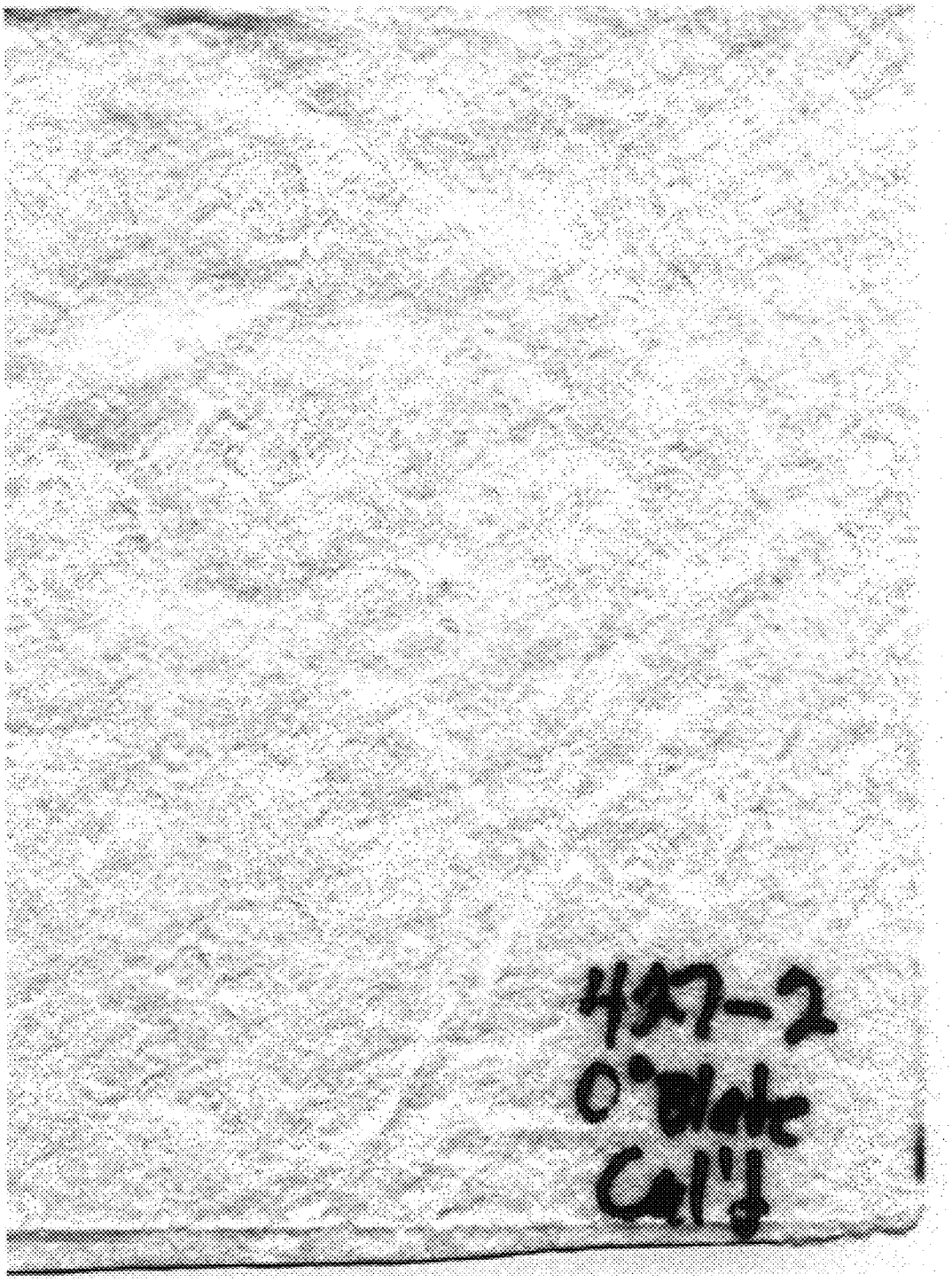
FIG. 8 is a photographic representation of a web produced according to the present invention and creped at a 0° angle.

FIG. 8 is a photographic representation of a web produced according to the present invention and creped at a 0° angle. As can be seen from the photograph, the surface of the web shows a number of inconsistencies.

Figure 9:
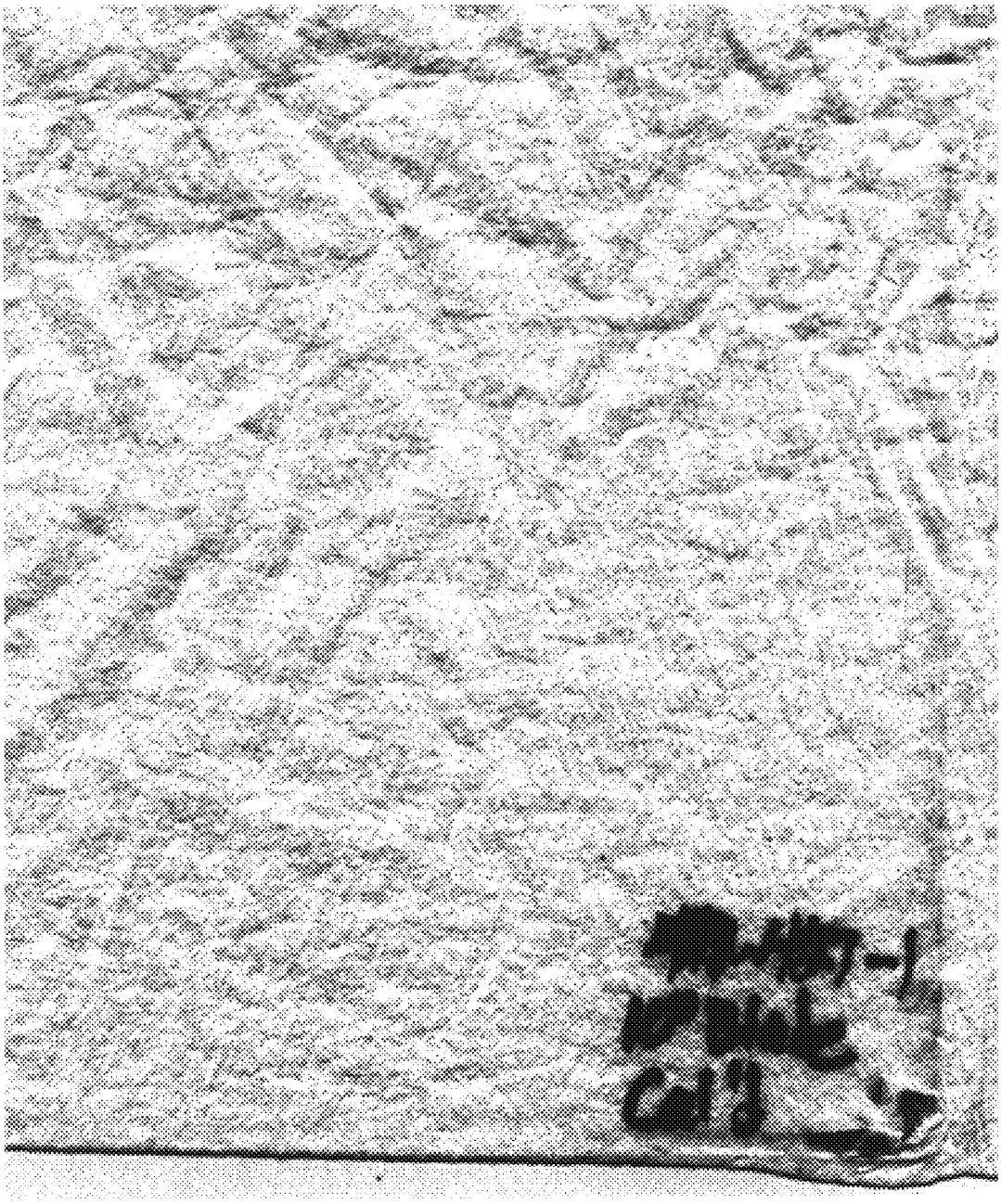
FIG. 9 is a photographic representation of a web produced according to the present invention and creped at a 10° angle.

FIG. 9 is a photographic representation of a web produced according to the present invention and creped at a 10° angle. As can be seen from this photograph, the surface of the web is smooth and continuous showing minimal crepe pattern.

Figure 10:
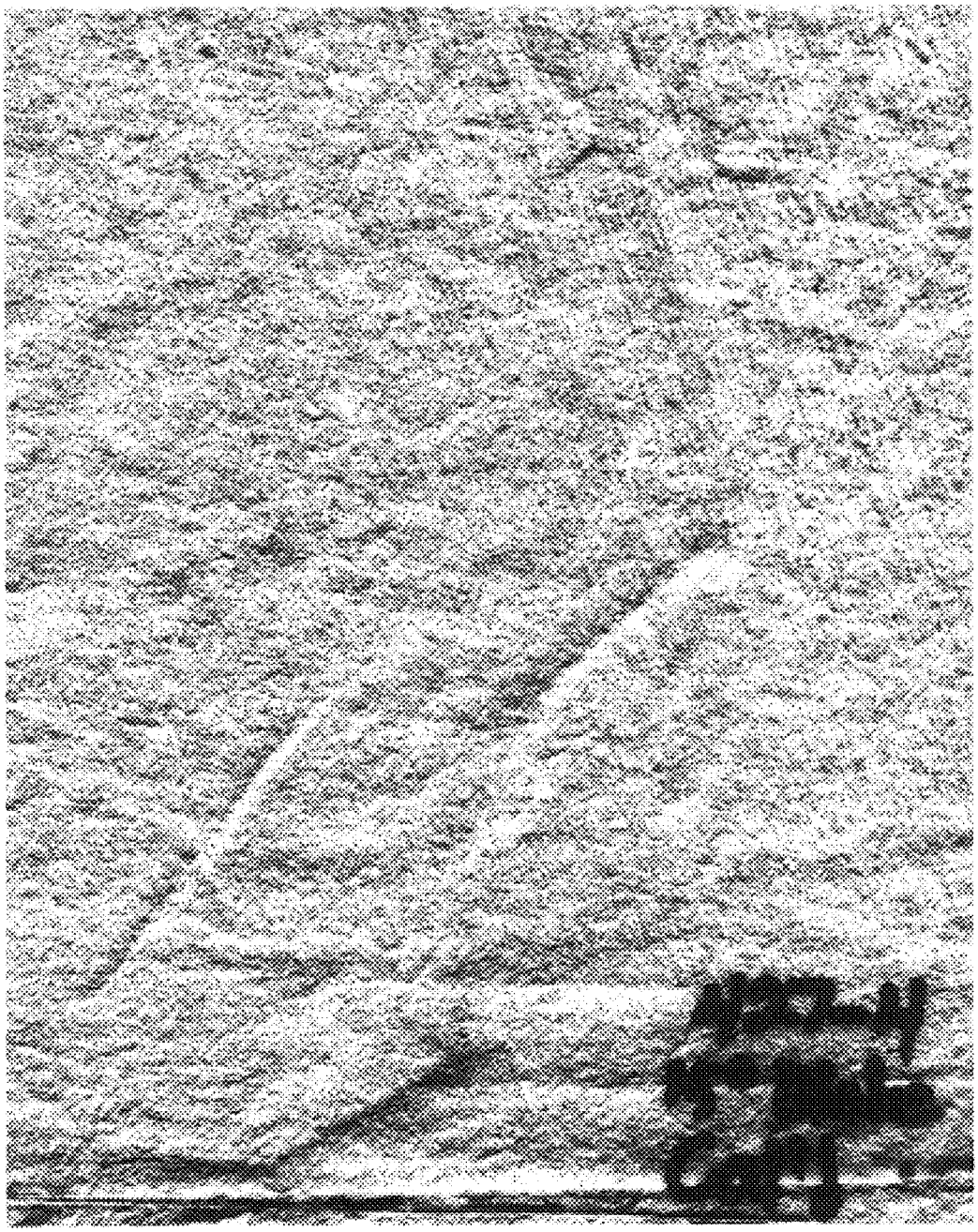
FIG. 10 is a photographic representation of a web produced according to the present invention and creped at a 15° angle.

FIG. 10 is a photographic representation of a web produced according to the present invention and creped at a 15° angle. As can be seen from this photograph, the surface of the web is smooth and continuous, again showing minimal crepe pattern.

The final product may be calendered or uncalendered and is usually reeled to await further converting processes. The products according to the present invention may be subjected to any art recognized converting operations, including embossing, printing, etc.

The web can be used to form single or multi-ply product benefitting from high internal volume or interruption of the pore structure in the interior of the sheet, including, for example, bathroom tissue, facial tissue, napkins, paper towels.

The following examples are illustrative of, but are not to be construed as limiting, the invention embodied herein.

EXAMPLES

Comparative Example 1

A web was produced from a slurry of furnish mixture of 50% bleached southern hardwood draft (BHWK) and 50% bleached southern softwood kraft (BSWK). the furnish contained chemicals to assist with creping and felt/wire cleaning. The furnish was not refined. A nascent web was deposited on a pressing felt and pressed to a solids content of 44%, prior to being adhered to a Yankee dryer. The web was creped from the Yankee drier at a solids content of less than 2% moisture using an 82° pocket angle and about 0.5 lbs/ton of creping adhesive and about 0.5 lbs/ton of release agent.

Figure 5:
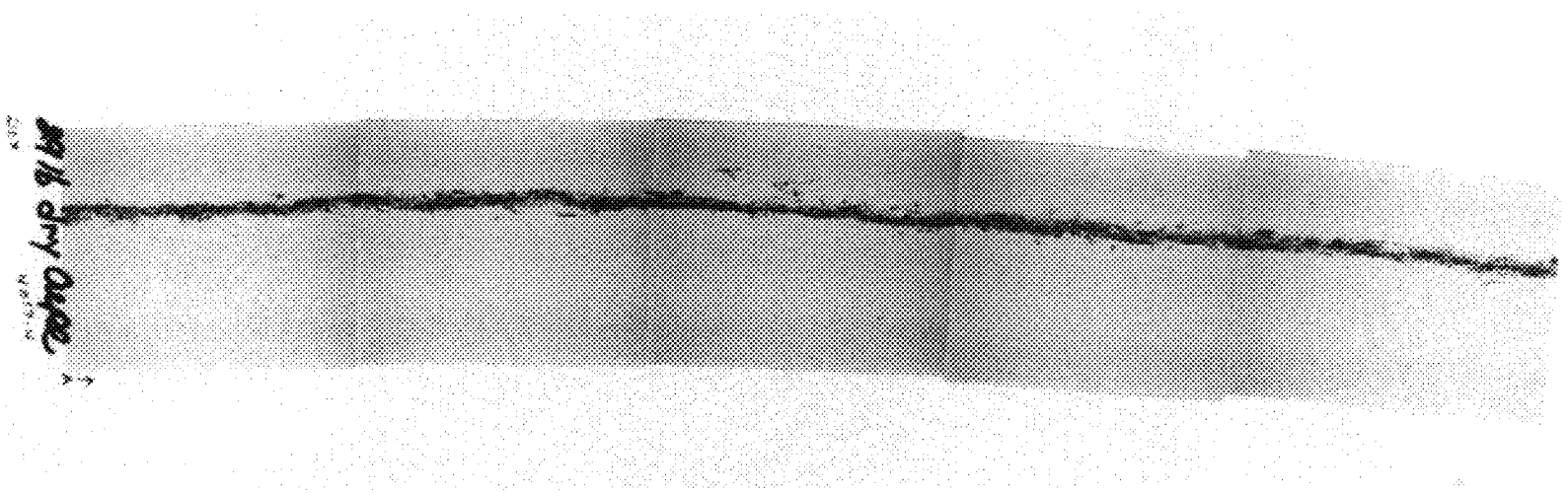
FIG. 5 is a 50× photographic representation of the cross machine direction of a 29 lb web that has been dry creped from a Yankee dryer.

FIG. 5 is a photographic representation of the cross machine direction of a 29 lb web that has been dry creped from a Yankee dryer. The representation is at a magnification of 50×. The photograph shows the degree to which the web was deboned by the severe creping action obtained by the low moisture creping.

Example 2

A web was produced as described in Example 1 ame fibers and furnish, except that the hoods were cooled down to reduce the dryness of the sheet at the creping blade. A nascent web was deposited on a pressing felt and pressed to a solids content of 44%, prior to being adhered to a Yankee dryer. The web was creped from the Yankee drier at a solids content of 55% and and a blade bevel of 15°. The web was subsequently pulled out using a pair of calender with rolls very lightly nipped with a resulting crepe of 15% left in the sheet. Percent crepe was calculated as Yankee speed-Calender speed/Yankee speed The sheet was then collected and dried to a solids content of about 95% while held in restraint by sheet restraining/drying racks at room temperature. This restrained drying was used to simulate applicable TAD or single fabric CAN drying. Multiple fabric can drying could also be used by might not exhibit such a dramatic effect in void volume, permeability, etc, due to the sheet compression during drying that is commonly encountered with this method.

Figure 6:
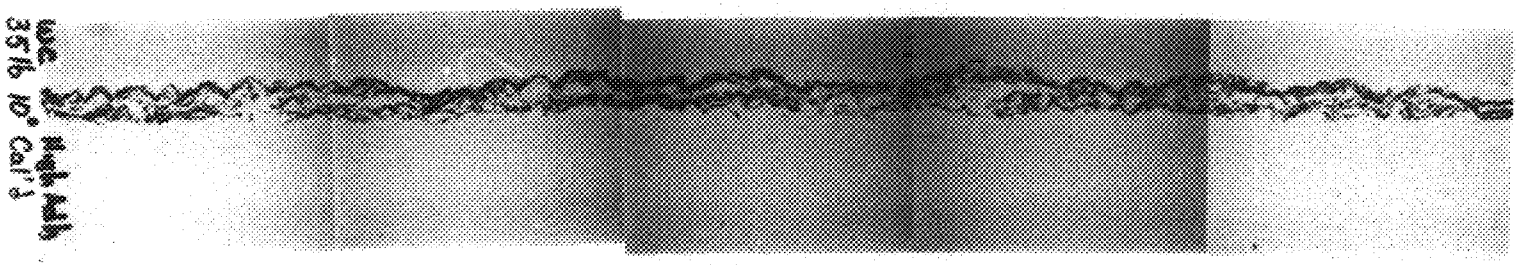
FIG. 6 is a 50× photographic representation of the cross machine direction of a 35 lb web produced according to the present invention and creped at a 15° angle, illustrating the delamination that occurs within the web.

FIG. 6 is a photographic representation of the cross machine direction of a 35 lb web produced according to the present invention. The web was creped from the Yankee dryer at a 15° angle. As can be seen from the 50× photograph, delamination of the fibers occurs within the web, thereby increasing bulk and absorbence of the web.

Example 3

A web was produced as in Example 2, except that the creping was carried out using a 10° bevel blade.

Figure 7:
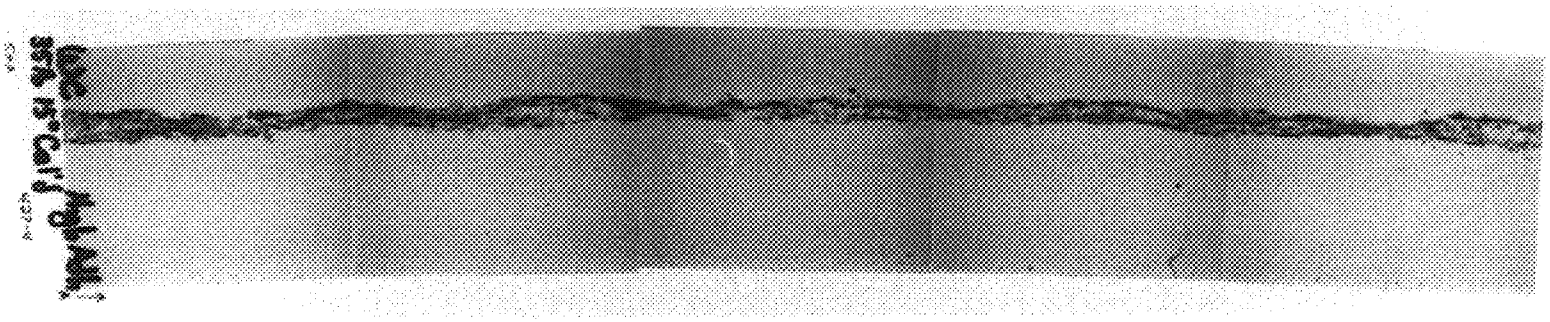
FIG. 7 is a 50× photographic representation of the cross machine direction of a 35 lb web produced according to the present invention and creped at a 10° angle, illustrating the delamination that occurs within the web.

FIG. 7 is a photographic representation of the cross machine direction of a 35 lb web produced according to the present invention. The web was creped from the Yankee dryer at a 10° angle. As can be seen from the 50× photograph, delamination of the fibers occurs within the web, thereby increasing bulk and absorbence of the web.

Example 4

A web was produced as in Example 2, except that the creping was carried out using a 0° bevel blade.

The above examples establish that this process responds much like a normal dry creping process, but the low internal cohesion of the fibers in the web due to its wetness amplify the creping effects.

It was quite surprising that the coating on the Yankee surface never changed through out the above examples. Similar processes carried out on a cooler Yankee resulted in significant changes in the coating on the Yankee making the coating difficult to establish and to maintain.

In the process according to the present invention, the amount of wear observed on the creping blade was significantly reduced below that which one would expect from a wet crepe process. By way of illustrative example, crepe blades used in wet creping processes would often be worn out in as little as 30 minutes, while the creping blade in the process according to the present invention still showed almost no wear after 2 hours.

Preferred products according to the present invention have the following attributes:

| Description | Basis Weight lbs./3000 $ft^2$ | Caliper Mills/1 Sheet | Absorbs Gms/$m^2$ | Void Volume, gms/gm | GM Tensile, gms/inch | GM Modulus, gms/% str |
|---|---|---|---|---|---|---|
| Example 1 Conventional Dry Crepe | 29.0 | 9.95 | 145 | 5.25 | 561 | 88.1 |
| Example 2 Invention w/ 15° | 34.2 | 14.9 | 272 | 6.79 | 589 | 107.2 |
| Example 3 Invention w/ | 34.1 | 16.6 | 303 | 7.84 | 506 | 75.0 |

-continued

| Description | Basis Weight lbs./ 3000 $ft^2$ | Caliper Mills/1 Sheet | Ab-sorbs Gms/ $m^2$ | Void Vol-ume, gms/gm | GM Tensile, gms/inch | GM Modulus, gms/% str |
|---|---|---|---|---|---|---|
| 10° Blade Example 4 Invention w/ 0° Blade Uncreped TAD Towel | 34.5 | 17.3 | 311 | 7.99 | 484 | 81.2 |
| Conventional Wet Crepe Towel | 25.7 | 22.1 | 931 | — | 1026 | 41.9 |
| | 31.5 | 12.8 | 208 | 5.32 | 1118 | 114 |

The results show an increase in air permeability of about 2 to 4 times those of a conventionally dry creped web, in spite of the fact that the comparative wet creped samples were 20% heavier than the dry creped samples.

Additional objects and advantages of the present invention will be apparent from the description, or may be learned by practice of the invention. The objects and advantages of the invention will be realized by the elements and combinations particularly pointed out in the appended claims.

We claim:

1. A method for causing delamination of the fibers within a fibrous web comprising forming a nascent web from a fibrous slurry;

adhering said web to a dryer from which said web may be creped;

creping said web from the dryer at a solids content below about 90% and when the web has a moisture profile that causes the fibers to shear, thereby resulting in delamination.

2. The method according to claim 1, wherein the solids content of the web is below about 75%.

3. The method according to claim 1, wherein the solids content of the web is between about 30% and about 90%.

4. The method according to claim 1, wherein the nascent web is wet pressed.

5. The method according to claim 1, wherein the nascent web is through air dried.

6. The method according to claim 1, wherein the creped web is further dried to a solids content greater than 95%.

7. The method according to claim 6, wherein the web is further dried using one of a through air dryer, a can dryer or an impulse drier.

8. The method according to claim 2, wherein the web is further dried using a through-air dryer.

9. The method according to claim 1, wherein the dryer from which the web may be creped is a Yankee dryer.

10. The method according to claim 9, wherein the Yankee dryer side of the web is at a temperature of from about 180 to about 230° F. upon creping.

11. The method according to claim 10, wherein the Yankee dryer is at a steam pressure of from about 50 to about 150 psi.

12. A method of forming a paper web comprising:

forming a nascent web from a fibrous slurry, adhering said nascent web to a dryer, said dryer being at a pressure between about 50 and about 150 psi;

creping said web from said dryer at a solids content between about 30% and 90% and when the web has a moisture profile that causes the fibers to shear, thereby resulting in delamination;

contacting said web with a second dryer to cause drying of said web to a solids content greater than 95%.

13. The method according to claim 12, wherein the web is creped at a solids content between about 40% and about 75%.

14. The method according to claim 12, wherein the nascent web is wet pressed.

15. The method according to claim 12, wherein the nascent web is through air dried.

16. The method according to claim 12, wherein said second dryer is a through air dryer, a can dryer or an impulse drier.

17. The method according to claim 16, wherein the second dryer is a through-air-dryer.

18. The method according to claim 12, wherein the dryer from which the web may be creped is a Yankee dryer.

19. The method according to claim 18, wherein the Yankee dryer side of the web is at a temperature of from about 180 to about 230° F. upon creping.

20. The method according to claim 18, wherein the Yankee dryer is at a steam pressure of from about 50 to about 150 psi.

* * * * *